United States Patent [19]

Ward et al.

[11] Patent Number: 4,860,673

[45] Date of Patent: Aug. 29, 1989

[54] TUFTING MACHINES

[75] Inventors: Gerald F. Ward, Mellor; Allan Beckett, Pleckgate, both of Great Britain

[73] Assignee: Tufting and Textile Systems Limited, Blackburn, United Kingdom

[21] Appl. No.: 203,992

[22] PCT Filed: Dec. 9, 1986

[86] PCT No.: PCT/GB86/00750

§ 371 Date: Aug. 8, 1988

§ 102(e) Date: Aug. 8, 1988

[87] PCT Pub. No.: WO87/03629

PCT Pub. Date: Jun. 18, 1987

[30] Foreign Application Priority Data

Dec. 10, 1985 [GB] United Kingdom ..... 8530355

[51] Int. Cl.[4] ..... D05C 15/06

[52] U.S. Cl. ..... 112/80.4; 112/80.42; 112/80.5; 112/80.55; 112/80.6

[58] Field of Search ..... 112/80.4, 80.42, 80.5, 112/80.55, 80.6

[56] References Cited

U.S. PATENT DOCUMENTS

| | | | |
|---|---|---|---|
| 2,977,905 | 4/1961 | Cobble et al. | 112/80.33 |
| 3,332,379 | 7/1967 | Cobble et al. | 112/80.33 |
| 3,665,873 | 5/1972 | Wittler | 112/80.42 |
| 3,748,914 | 7/1973 | Parsons | 112/80.42 X |
| 3,830,174 | 8/1974 | Mellor . | |
| 4,187,788 | 2/1980 | Cobble | 112/80.55 |
| 4,217,837 | 8/1980 | Beasley et al. . | |
| 4,301,751 | 11/1981 | Caylor . | |
| 4,354,441 | 10/1982 | Hurst | 112/80.6 |
| 4,375,196 | 3/1983 | Beasley | 112/80.6 |
| 4,491,078 | 1/1985 | Ingram . | |
| 4,509,439 | 4/1985 | Densmore et al. | 112/80.5 X |
| 4,693,191 | 9/1987 | Card | 112/80.6 |

FOREIGN PATENT DOCUMENTS

| | | | |
|---|---|---|---|
| 2833312 | 2/1979 | Fed. Rep. of Germany . | |
| 2002039 | 2/1979 | United Kingdom | 112/80.42 |

*Primary Examiner*—Ronald Feldbaum

*Attorney, Agent, or Firm*—Pravel, Gambrell, Hewitt, Kimball & Krieger

[57] ABSTRACT

A tufting machine comprises parallel looper and knife mechanisms independently driven via variable-stroke eccentric mechanisms and timing belt transmission arranged at least at one end but generally both ends of the machine, the driven parts of said mechanisms being longitudinally spaced from a parallel-disposed vertically-adjustable jute or cloth bedplate whereby the central area of the machine between the drive parts of the mechanisms and the bedplate is substantially free from driving shafts and ancillary driving components to give the operator substantial accessibility for maintenance and replacement purposes.

31 Claims, 11 Drawing Sheets

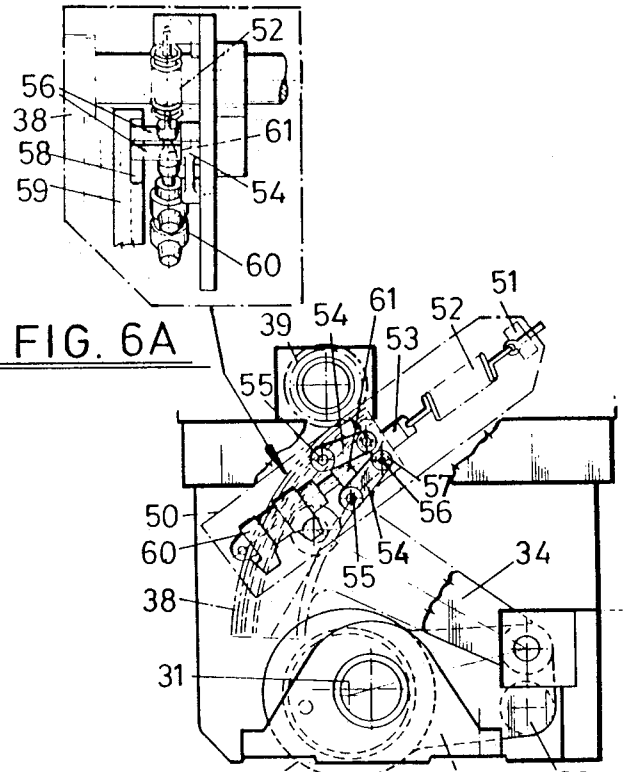
FIG. 6
FIG. 6A
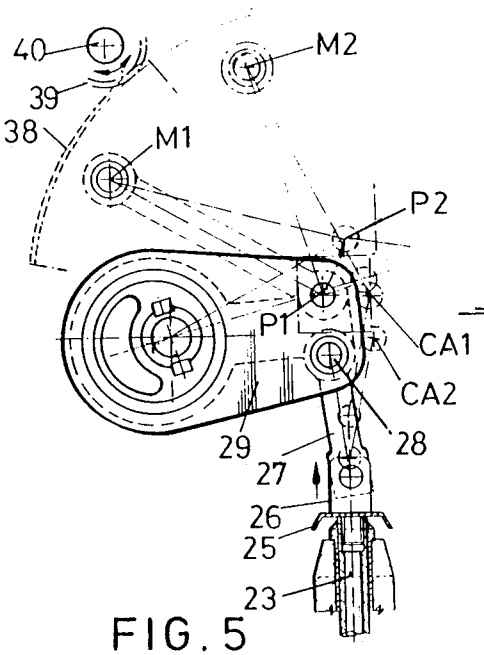
FIG. 5

TUFTING MACHINES

This invention relates to tufting machines and is concerned with improving the construction and functioning of certain of the mechanisms traditionally employed in such machines.

According to a first aspect of the present invention, a tufting machine comprises parallel looper and knife mechanisms independently driven via variable-stroke eccentric mechanisms and timing belt transmission arranged at least at one end of the machine, the looper and knife mechanisms being parallel with a vertically-adjustable, longitudinally-extending jute or cloth bedplate, and the driven parts of said looper and knife mechanisms being longitudinally spaced from an end or the ends of the bedplate whereby the central area of the machine between said driven parts of the mechanisms and the bedplate is free from driving shafts and ancillary driving components to give the operator substantial accessibility for adjustment, maintenance and component replaement purposes.

Preferably the driven mechanism for the looper mechanism comprises a rocker shaft connected by crank arms to support levers which carry the looper mechanism and which oscillate about pivot locations on the ends of support arms supported in bearings on the rocker shaft of the knife mechanism.

Preferably the knife mechanism is directly supported on crank arms connected to its rocker shaft.

The knife mechanism is preferably of modular constuction comprising a plurality of blade carrier modules, each supporting, for example, four side-by-side blades.

Each carrier module preferably has an outwardly-directed bottom flange adapted to be secured to the underside of a knife bar and an upturned hook formation adapted to be engaged and secured by a clamping lug secured to the knife bar.

The looper mechanism preferably comprises a sectioned bar formed with a series of relatively shallow parallel slots in each of which is accommodated a wall section with adjacent wall sections defining relatively deep slots each for accommodating a looper blade.

Preferably the looper blades are locked in the slots by a loose clamping plate screwed to the sectioned looper bar, grub screws in the clamping plate engaging against angled faces of the looper blades.

A carrier bar preferably supports the sectioned looper bar and overlies the looper blades to provide an exact datum location for same.

Preferably, the needle bar of the tufting machine is adapted for reciprocation and connected via a pivotal or flexible linkage system to an eccentric drive adapted to impart the reciprocatory action to the needle bar and to an adjusting mechanism adapted to predetermine the length of stroke of reciprocation of the needle bar, and consequently of needles carried by said needle bar, and adjusting mechanism comprising a gear arrangement operable from one end of the tufting machine and pivotally connected to the linkage system, the gear arrangement being adjustable to bodily move its pivot connection with the linkage system, and consequently the linkage system per se, thereby to adjust the length of stroke of the needle bar.

Such adjustment causes an automatic adjustment of the point of connection between the linkage system and the eccentric drive.

The pivotal or flexible linkage preferably comprises a link pivoted to a push rod of the needle bar and connected to a cross shaft driven by the eccentric drive, and a stroke-adjusting link pivotally connected to the push rod link via a pair of connecting links, the stroke-adjusting link being pivotally connected to a gear quadrant adjustable along an arcuate path by a gearwheel, the gear quadrant having arms pivoted to a fixed location of the tufting machine.

The above arrangement results in the pivoted links being subjected to bodily and pivotal movements upon an arcuate movement of the gear quadrant thereby effecting the aforesaid stroke adjustment.

Preferably the stroke-adjustment mechanism comprises a clamping arrangement to lock it in adjusted position.

The clamping arrangement preferably comprises a releasable mechanical locking means between a fixed machine location and the gear quadrant and adapted to resist such arcuate movement.

Preferably the mechanical locking means comprises a pair of pivoted arms adapted to be urged into locking contact with the walls of a channel associated with the gear quadrant by spring means to resist arcuate movement of the latter.

A wedge preferably is provided to force the pivoted arms into said locking contact under the action of the spring means.

The wedge is preferably also controlled by a piston-and-cylinder device which serves to remove it from between the pivoted arms against the action of the spring means to release the locking action and permit arcuate movement of the gear quadrant under the action of the gearwheel.

The quadrant-controlling gearwheel is fast on a shaft preferably manually rotatable from one end of the machine to effect stroke length adjustment.

Preferably the manual control mechanism comprises a rotatable handwheel connectible to an adjustment shaft adapted to rotate the gearwheel shaft via a reduction gear box.

Preferably the handwheel is adapted to be axially engaged with the adjustment shaft before rotation of the latter by the handwheel can be effected.

Preferably the axial engagement of the handwheel with the adjustment shaft simultaneously operates the piston-and-cylinder device to release the clamping arrangement of the stroke adjusting mechanism.

Complementary stop means are preferably provided on a rotating component of the gear shaft and a fixed location of the machine to limit the arcuate travel of the gear quadrant.

Indicating means is preferably driven from the gear shaft and belt transmission to show the amount of needle stroke adjustment being effected.

The manually-operated handwheel may be replaced by a drive motor/gearbox combination to provide a powered stroke length adjustment of the needle bar.

Preferably the drive motor is controlled by limit switches to control the degree of arcuate travel of the gear quadrant.

Preferably the needle bar is formed with an integral threader bar and is of extruded construction.

Preferably the extruded needle/threader bar is accommodated in a recess in a sliding carrier wherein it is secured by overlying locking strips, the carrier being of dovetail cross-section and received in a complementarily-shaped recess in a push rod bracket where it is maintained in position by an angle-faced retaining strip.

The needle bar may be fixed, i.e. it does not move across the machine, and, in this instance, it is held in a recess of a push rod assembly by overlying locking strips.

The various aspects of the tufting machine according to the present invention will now be described, by way of example, with reference to the accompanying drawings, in which:

FIG. 5 is a schematic side view corresponding to FIG. 4 illustrating the movements of the linkage system of the stroke adjustment mechanism;

FIG. 6 is a side elevation of the gear quadrant clamping arrangement;

FIG. 6A is a detail end view of FIG. 6;

Figures 1, 2:
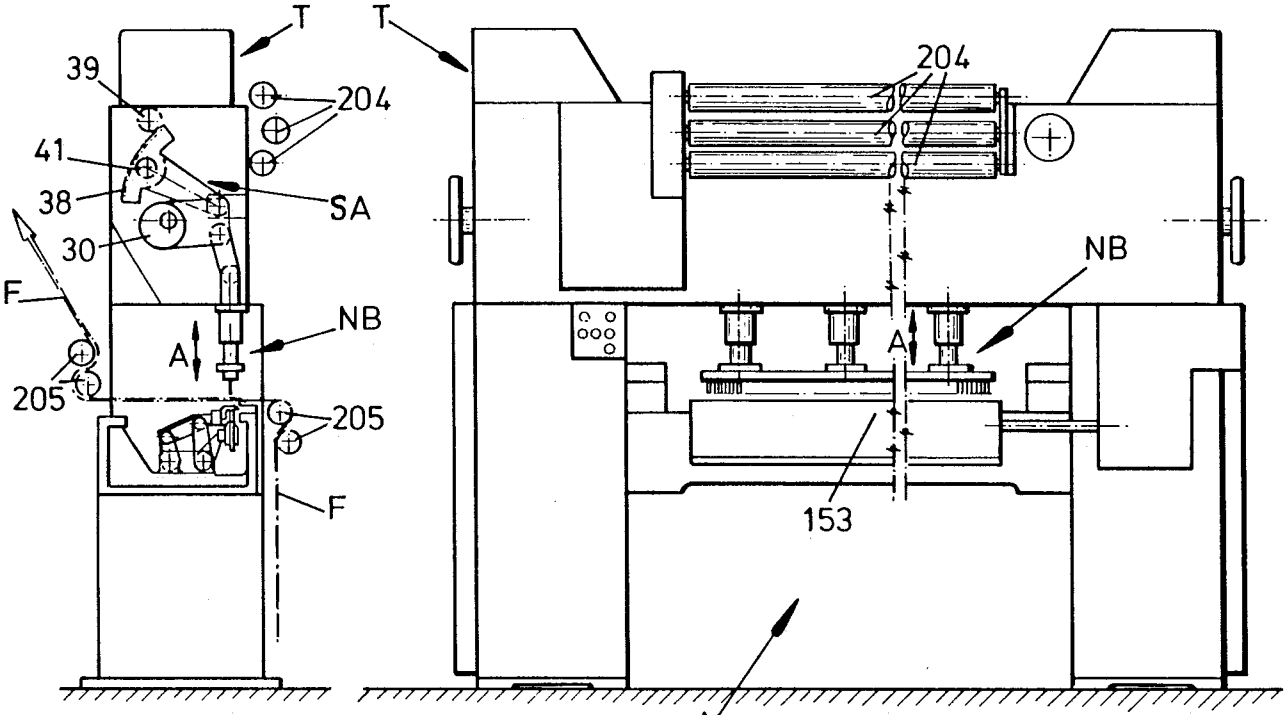
FIGS. 1 and 2 are respectively a transverse sectional view and a fragmentary front view of a tufting machine to which the present invention is applied.
Figure 3:
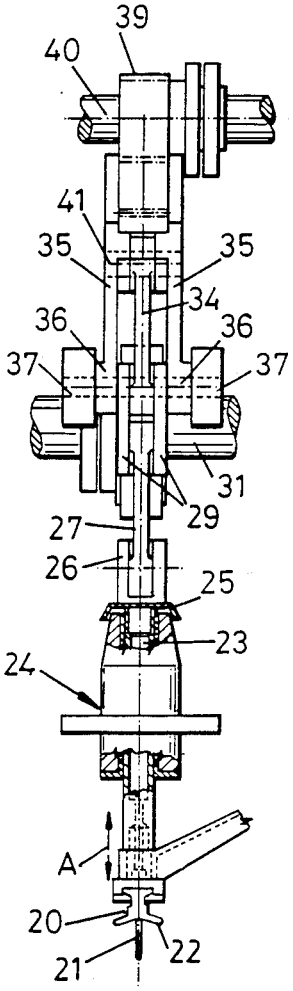
FIG. 3 is a fragmentary part-sectional end view of the needle bar stroke adjustment mechanism.
Figure 4:
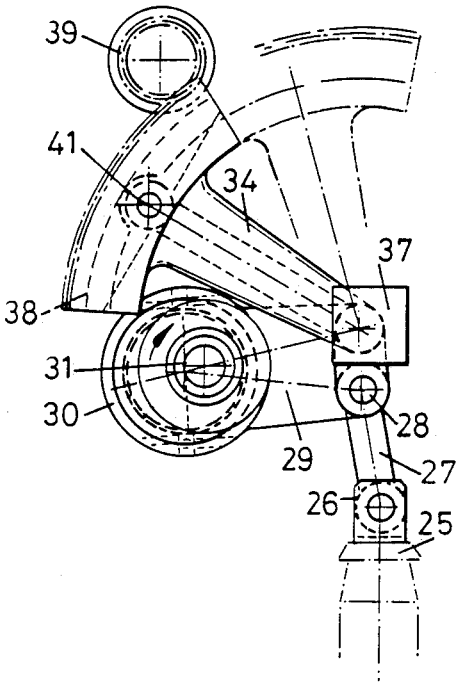
FIG. 4 is a side view corresponding to FIG. 3.
Figure 7:
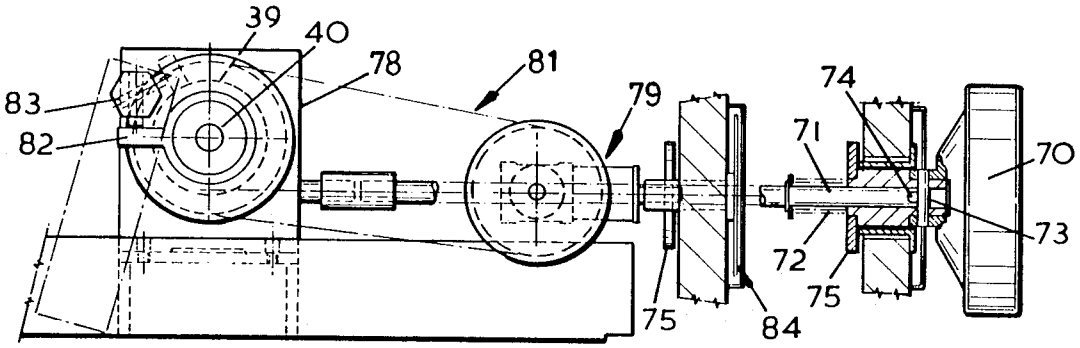
FIG. 7 is a fragmentary part-sectional side view of the gear quadrant (stroke adjustment) operating mechanism.
Figure 8:
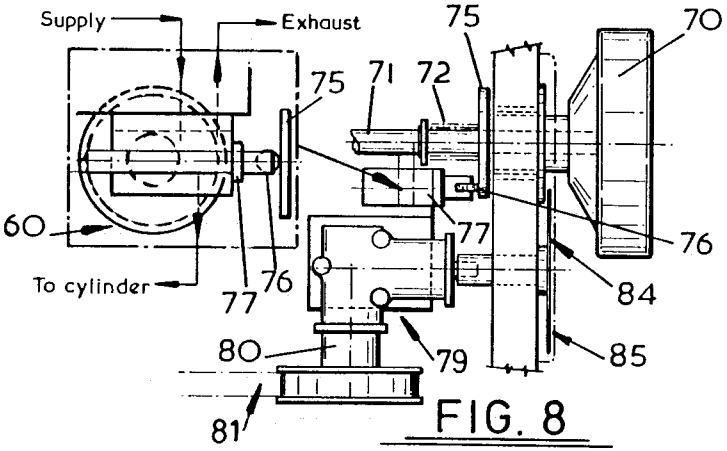
FIG. 8 is a fragmentary plan view corresponding to FIG. 7.

The tufting machine to which the mechanisms according to the invention are applied is indicated at T (FIGS. 1 and 2) and the cloth or fabric path through the tufting machine is indicated by the reference F and is the conventional one for such a machine. The improved and modified mechanisms resulting from the present invention will be described in detail with reference to FIGS. 3 to 24, and will be generally indicated in FIGS. 1 and 2.

The general construction and functioning of tufting machines is well known to those skilled in the art and for this reason the following description and the drawings referred to therein are restricted to the construction and functioning of the aforesaid improved and modified mechanisms.

Referring to FIGS. 3 to 8 of the drawings, the tufting machine comprises a needle bar assembly NB (FIGS. 1 and 2) including a needle bar 20 mounting needles 21, the needle bar 20 being subjected to a vertical reciprocating action as indicated by the arrow A. A yarn guide is connected to the needle bar and is generally indicated by the reference 22.

The needle bar 20 is reciprocated by push rods 23 connected thereto and reciprocable in a bearing arrangement 24 incorporating a lubricating oil guard 25.

Each push rod 23 terminates at its upper end in a fork 26 in which is pivoted a link 27 connected, in turn, by a pin 28 to a forked connecting arm 29 fast with an eccentric 30 mounted on a drive shaft 31 supported in bearings (not shown).

It will be manifest that rotational action of the eccentric 30 imparts a vertical component of movement to the link pin 28 and consequently to the links 27, push rods 23 and the needle bar 20.

It is important to be able to adjust the length of stroke of the needles 21 to determine the height of the pile, and the present invention provides such an adjustment which, unlike existing stroke adjustment arrangements, can be effected outside and at an end of the tufting machine remote from the actuating needle mechanism.

The stroke adjustment mechanism SA (FIGS. 1 and 2) comprises a stroke-controlling link 34 pivoted to the forked connecting arm 29 and which lies within a forked stroke-adjusting link 35 pivoted at one end as indicated at 36 in support blocks 37 fixed to the machine frame, and other end of the forked stroke-adjusting link 35 being formed as or having connected thereto a toothed quadrant 38 which is adjustable by means of a meshing gearwheel 39 carried by a drive shaft 40 controllable, as aforesaid, from an end of the tufting machine.

The stroke-controlling link 34 is pivoted at its other end as indicated at 41 between the arms of the fork 35.

Hence, adjustment of the toothed quadrant by the gearwheel 39 causes an adjustment in the position of the link 34 between a maximum position M1 and a minimum position M2 (FIG. 5).

The position of pivot point 36 is consequently adjusted between positions P1 and P2 and due to the flexible (pivotal) nature of the connection between link 34, links 33 and link 27 the stroke of push rod 23 and consequently of the needles 21 is adjustable.

This, in turn, involves an automatic shift in the position of the link pin 28 to which the eccentric connecting arm 29 is pivoted between a TDC maximum position CA1 and a TDC minimum position CA2.

A clamping arrangement is provided to secure the quadrant in adjusted position and an actuating arrangement is provided for effecting quadrant adjustment.

The quadrant clamping arrangment comprises a mounting plate 50 fixed relative to the machine framework and having secured to a bracket 51 thereon one end of a spring 52 whereof the other end is secured to a bracket 53 attached to an extension on wedge 61.

Movement of the quadrant 38 is resisted by a pair of locking arms 54 pivoted on the plate 50 at 55 and having extending at right angles therefrom pins 56 mounting locking rollers 57 which project into a channel 58 in a plate 59 secured to the quadrant 38.

The plate 50 also mounts a single-acting pneumatic piston-and-cylinder device 60 for operating a wedge 61 which, when the piston-and-cylinder device 59 is extended, is pulled between the pins 56 by the spring 52 to force the locking rollers 57 against the side walls of the channel 58 thereby to lock the quadrant 38 against movement.

Retraction of the piston-and-cylinder device 60 against the spring 52 removes the wedge 61 from between the pins 56 thereby rendering the locking arms 54 freely pivotal at 55 thus allowing the quadrant 38 to be moved about its arcuate path.

Such movement of the quadrant 38 is, of course, imparted by the gearwheel 39 with which the quadrant 38 is in mesh.

The quadrant 38, and consequently the needle stroke, can now be adjusted.

This adjustment is effected manually at the end and outside of the machine by a handwheel 70 which is free to spin relative to an operating shaft 71. The handwheel 70 requires to be positively axially moved against the action of a spring 72 to engage a dog or cross pin 73 in a cross groove 74 in the operating shaft 71 thereby preventing any inadvertent adjustment of the needle stroke. This axial movement of the handwheel 70 causes it also to switch the air supply of the piston-and-cylinder device 60 to cause it to retract the wedge 61 from between the pins 56 as aforesaid. The handwheel 70 carries a flange 75 which strikes the actuator 76 of a changeover valve 77 of the air supply system of the piston-and-cylinder device 60. Thus the axial movement of the handwheel 70 both releases the quadrant clamping arrangement and renders the needle stroke adjustment actuating arrangement operational.

Rotation of the handwheel 70 causes the shaft 71 to drive a worm box mechanism generally indicated at 78 which, in turn, drives the shaft 40 to rotate the gearwheel 39 which adjusts the quadrant 38 and the needle stroke as aforesaid.

Release of the handwheel 70, it will be manifest, causes the spring 72 to move it axially outwards to disengage the dog 73 from the groove 74 and at the same time separates the flange 75 from the actuator 76 thus operating the changeover valve 77 to cause the piston-and-cylinder device 60 to drive the wedge 61 between the pins 56 thereby to lock the quadrant in adjusted position.

The shaft 40 carries a stop 82 on one face for abutment with a fixed stop 83 on the machine. These stops 82, 83 restrict rotation of the shaft 40 and the gearwheel 39 to ensure that separation of the quadrant 38 from the gearwheel does not occur.

An indicator disc 84 provided with a datum hole 85 is driven from a bevel gear mechanism 79 relative to a scale indicating stroke length adjustment whereby the operator can see the stroke length adjustment he is making and ensure that it is correct. The bevel gear mechanism 79 is driven from the worm box mechanism by an endless timing belt transmission 81.

It is to be noted that, because the needle stroke adjustment is at an end of the machine, adjustments can be made while the tufting machine is running. This is a substantial advance on existing machines where adjustments require to be made individually within the machine which, of course, necessitates machine stoppage.

Figure 10:
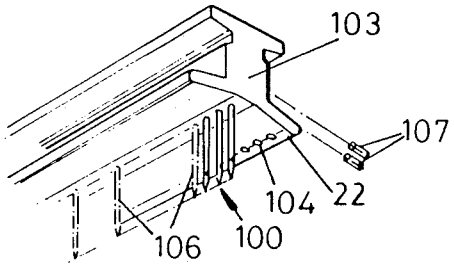
FIG. 10 is a fragmentary perspective view of the needle bar.
Figure 9:
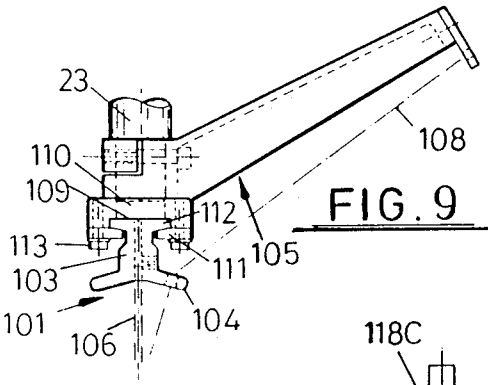
FIG. 9 is an end view of a fixed needle bar assembly.
Figure 11:
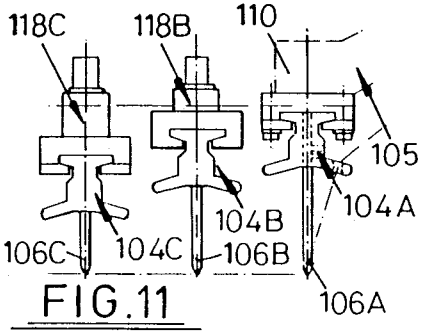
FIG. 11 is a view of three different needle mounting arrangements for accommodating different needle lengths.
Figure 12:
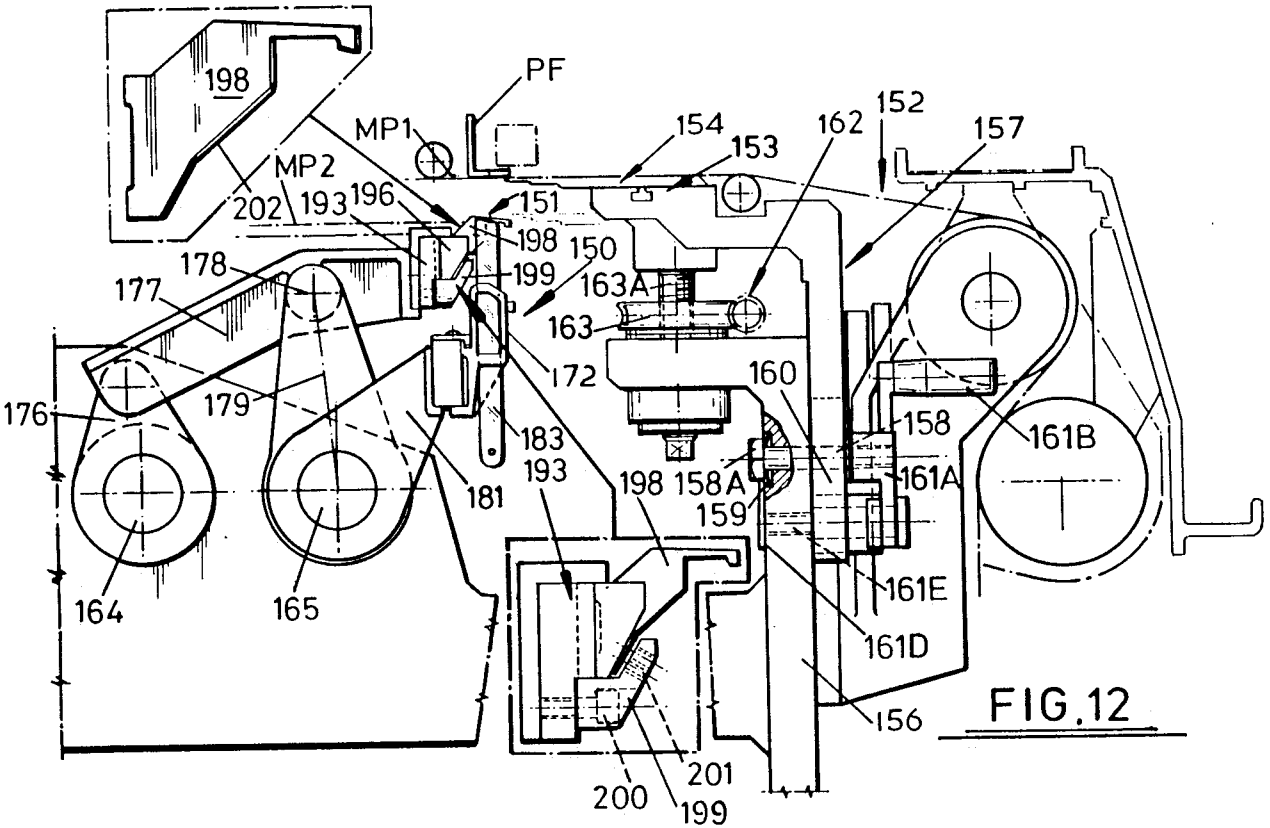
FIG. 12 is a side view showing the knife and looper mechanisms, the bedplate and the drives and supports for these mechanisms.
Figure 14:
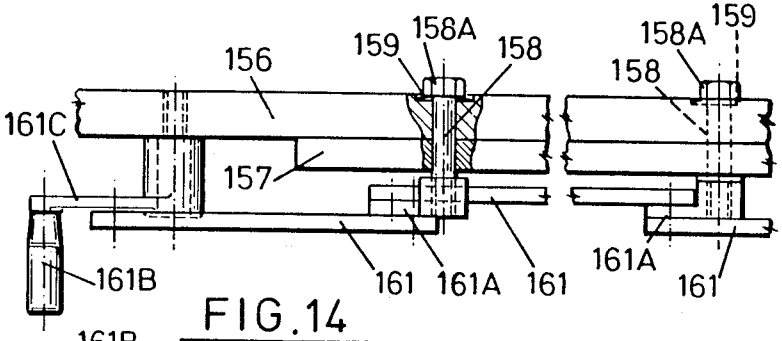
FIG. 14 is a plan view of the bedplate adjustment machanism.
Figure 15:
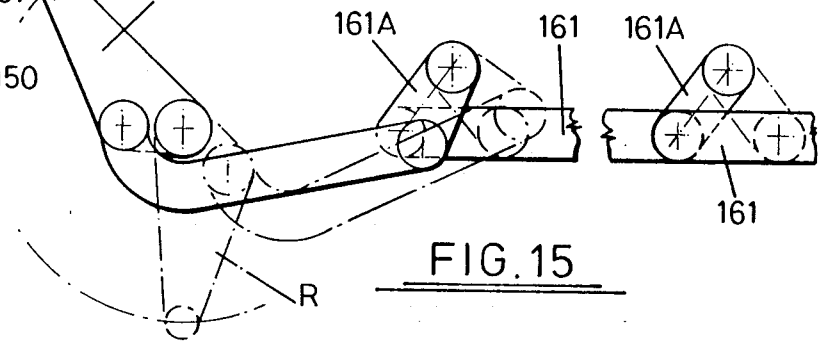
FIG. 15 is an end view corresponding to FIG. 14.
Figure 13:
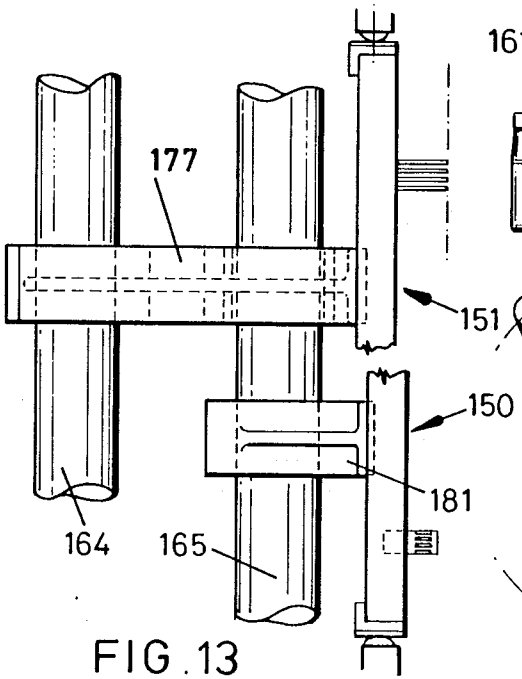
FIG. 13 is a plan view corresponding to FIG. 12 of the knife and looper mechanisms and supports therefor.
Figure 16:
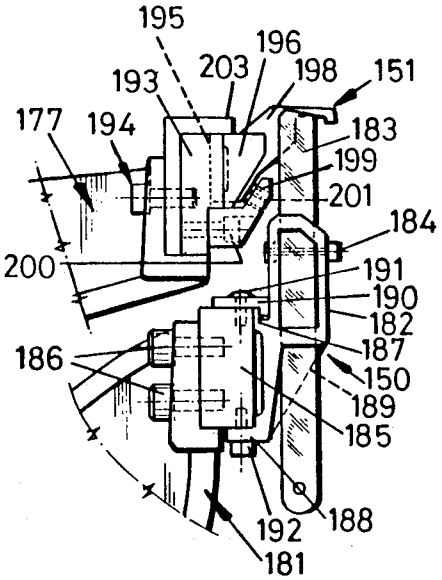
FIG. 16 is a detailed end view of the knife and looper mechanisms.
Figure 19:
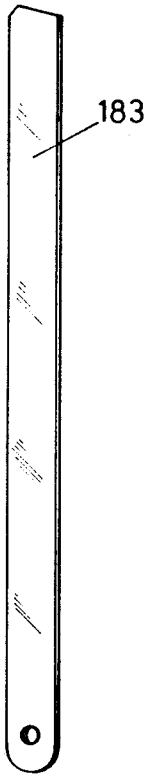
FIG. 17 to 19 are respectively a front view of a knife module, a corresponding side view and a side view of a knife.
Figure 18:
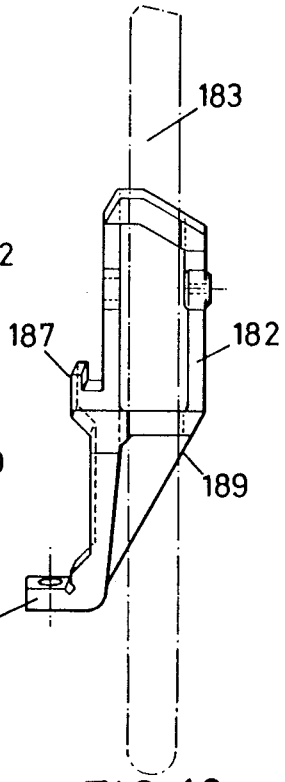
Figure 17:
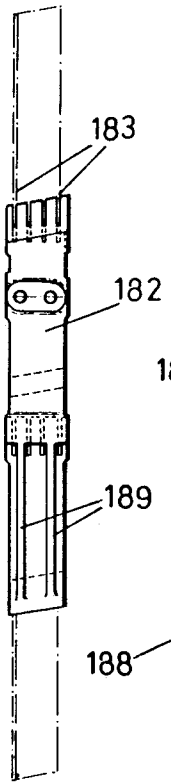
Figure 21:
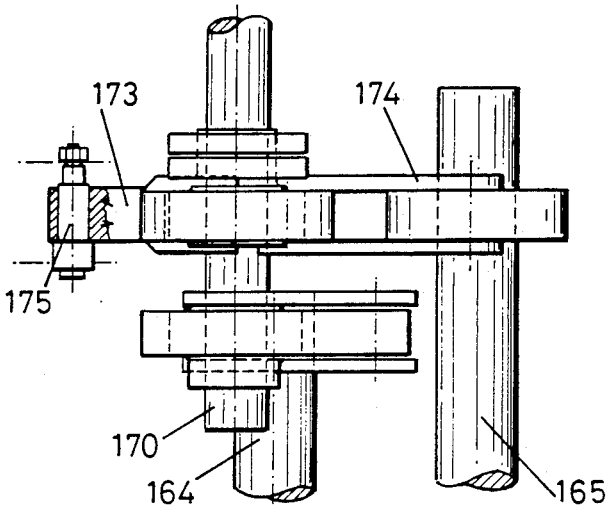
FIG. 21 is a plan view corresponding to FIG. 20.
Figure 20:
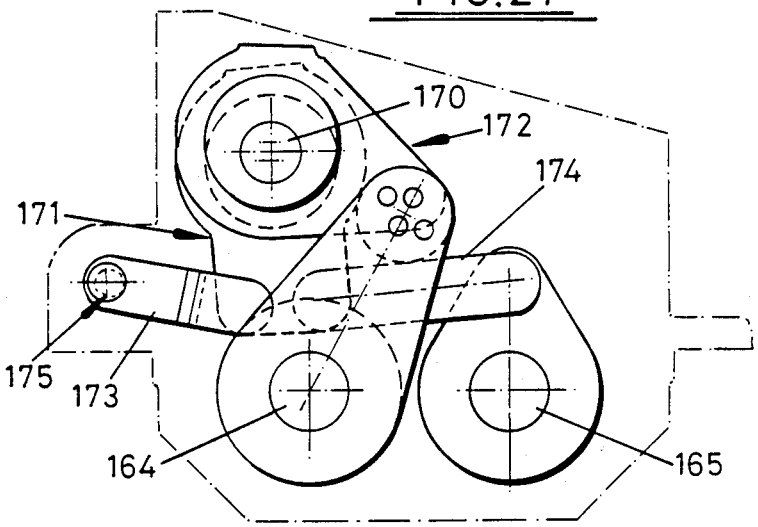
FIG. 20 is a view of the looper and knife drives.
Figure 22:
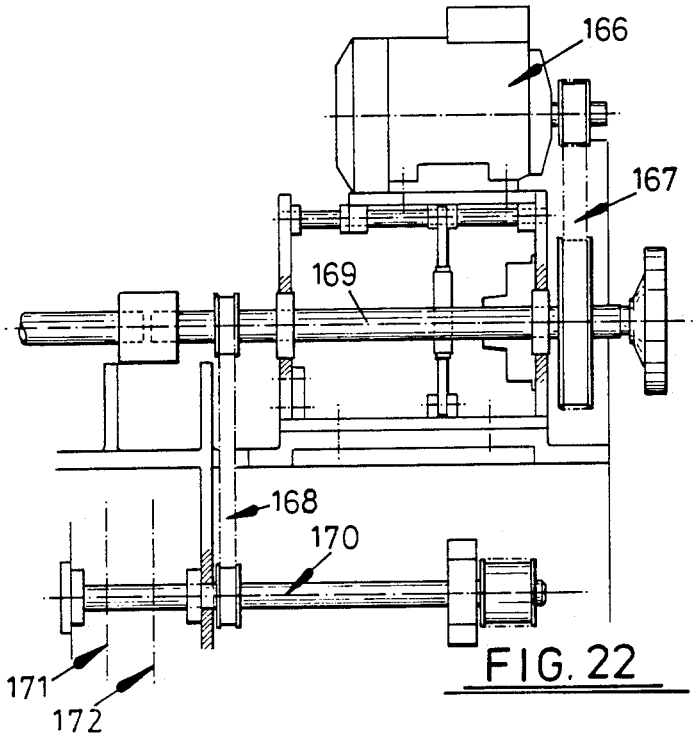
FIG. 22 is an end view of the machine drive assembly.
Figure 24:
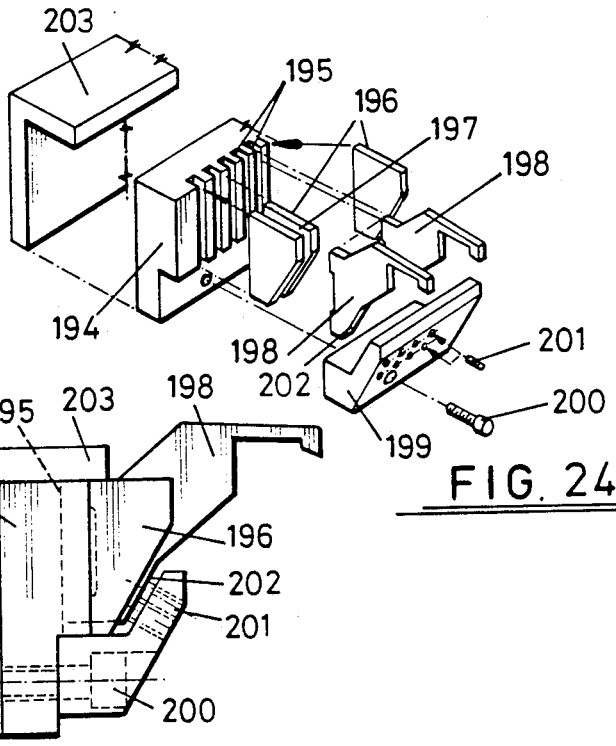
FIGS. 23 and 24 are respectively a side view and exploded perspective view of a preferred looper assembly.
Figure 23:
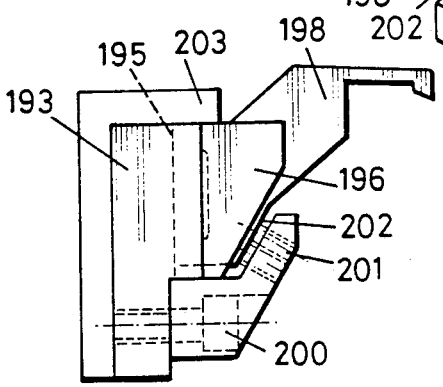

Reference is now made to the needle bar assembly generally indicated at 100 (see FIGS. 9 to 11).

The needle bar assembly is a fixed assembly 101 (FIG. 9).

The needle bar 103 has integral therewith the threader plate 104. The integrated needle plate and threaded plate is extruded and is of a lower mass than conventional separate but interconnected needle plates and threader plates. A significant mass reduction of at least 30% is possible with increased bending stiffness.

The integral needle/threader plate 103, 104 is releasably clamped on the foot assembly 105 which is secured to the push rod 23.

The integral needle/threader plate 103, 104, as is customary, supports a row of needles 106 in holes in the bar 103, 104, the needles being releasably held by grub screws 107 or similar. Yarn is generally indicated at 108.

The combined needle/threader bar 103, 104 sits in a recess 109 of the bracket 110 of the foot assembly 105 and is held stationary in the recess 109 by locking strips 111 overlying flanges 112 of the bar 103, 104, which locking strips 111 are bolted to the bracket 110 as indicated at 113.

In setting up the needle array of a tufting machine it is known that the datum to which the setting-up operator works is the back of the eyes of the needles, i.e. the backs of the needle eyes must be aligned to the bottom dead centre (BDC) datum. Due to differences in needle lengths (see needles 106A, 106B and 106C) it is sometimes necessary to employ packing or sometimes accept a certain amount of non-alignment. To overcome this drawback it is a feature of this invention to provide the needle bars generally indicated at 104A, 104B and 104C (FIG. 11) with screwed extension pieces 118B and 118C in the case of needle bars 104B and 104C to ensure a proper datum in the needle array. These extension pieces 118B, 118C as can be seen are of different lengths but when screwed into the brackets 110 of the foot assemblies 105 the backs of the eyes of all of the different length needles 106A, 106B and 106C will be aligned to the BDC datum.

It is to be noted that the clamping arrangement described above allows the needle/threader bar to sit in a relatively deep recess or groove which improves the vertical stiffness of the bar compared with existing arrangements.

Also the combined needle/threader plate of this invention is dimensionally smaller and of less mass than existing needle and threader plate assemblies and in consequence reduces the disturbing forces normal in tufting machines during operation.

The yarn can be fed to either side of the combined needle/threader plate particularly if the needles are in staggered array.

Reference is now made to FIGS. 12 to 19 of the drawings, which are concerned with the looper and knife mechanisms of the tufting machine.

The knife mechanism is generally indicated at 150 and the looper mechanism at 151.

The jute or cloth line is indicated at 152 and the maximum and minimum pile levels at MP1 and MP2 respectively.

As is usual, the jute or cloth bedplate 153 is vertically adjustable relative to a fixed framework structure 154. The bedplate 153 again as is usual, carries a reed plate carrier 154.

The bedplate 153 is carried by a bracket structure 157 vertically adjustable to the framework structure 156 to which it is movably clamped through a series of bolts 158 each engageable in a lever-nut 161A having associated with it a Belleville spring 159. The bolts 158 each extend through a vertical slot 160 in the bracket structure 157 whereby the vertical movement of the bedplate 153 can be effected. The bolts 158 are linked together for rotational purposes by connecting links 161 and lever arms 161A, the links 161 being simultaneously movable to unscrew the nut 161A from the bolts 158 by angular movement of an operating handle 161B from locking position L to release position R and to tighten them into screw engagement with the nuts 161A by reverse movement (position R to position L). The connecting link 161 to which handle 161B is connected is pivoted on framework structure 156 by an eccentric stud (not shown but at position 161C), the handle 161B and consequently the links 161 and levers 161A being locked in clamping position when the arrangement is in over-centre configuration.

A plate 161D mounted on frame 156 is butted against the bolt head 158A to prevent inadvertent bolt rotation and release of the bracket structure 157.

Vertical adjustment of the bracket structure 157 and consequently the bedplate 153 is by a worm drive 162 to a pinion 163 on a screw shaft 163A connected to the bracket structure 157, the rotating worm wheel 163 operating to cause vertical movement of the bracket structure 153.

The usual presser foot is referenced PF.

The present invention provides for a rearrangement and relocation of the kinematic linkages and mechanisms for the knives and loopers thereby substantially to assist maintenance and replacement by, in effect, leaving the interior of the machine, i.e. the area A in FIGS. 1 and 2 between the looper and knife mechanisms and the bedplate, relatively free of driving shafts and ancillary driving components.

The rocker shafts 164 and 165 respectively for the looper and knife mecahnisms 151 and 150 are driven by a motor 166 at an end of the machine via timimg belts 167, 168 (see FIGS. 20 to 22), a main machine shaft 169, layshafts 170 (only one shown) and variable-stroke mechanisms driven by eccentrics 171 and 172 respectively. The strokes of the latter are adjustable by the adjustable eccentric spindle 175.

The eccentrics 171, 172 are separately and independently timing adjustable and driven.

The looper rocker or oscillating shaft 164 (FIG. 12) is connected by crank arms 176 to support levers 177 which carry the looper mechanism 151. These support levers 177 rock or oscillate about pivot locations 178 at the ends of support arms 179 which are supported on the knife rocker or oscillating shaft 165 via needle bearings.

The rocker shaft 165 is connected to the knife mechanism by crank arms 181.

Thus the stroke and timing of the loopers and knives is independent one of another.

The knife mechanism 150 (FIGS. 16 to 17) is of modular construction and is built up of a series of blade carrier modules 182 adapted, in this instance, to support four side-by-side blades 183.

Each carrier module 182 is formed with four blade-receiving slots 183 secured in the carrier module 182 a screw clamp arrangement 184.

Each carrier module 182 is adapted to be secured on the knife bar 185 supported by the crank arms 181, the knife bar 185 being bolted to these arms 181 as indicated at 186.

For securement purposes, the carrier module 182 is provided on its rear face, i.e. its face abutting the knife bar 185 with an upturned hook formation 187 substantially midway of its height and, at its bottom, with a rearwardly-extending flange 188.

Strengthening ribs 189 are provided on the lower part of the front face of the carrier module 182. The carrier modules 182 are secured to the knife bar 185 by clamping lugs 190 which engage in the hook formation 187 and are bolted as indicated at 191 to the top of the knife bar 185, and by the flange 188 which is bolted as indicated at 192 to the bottom of the knife bar 185.

Referring now to the looper mechanism 151 (FIGS. 12, 16 and 23 and 24), this, according to the present invention, comprises a sectioned bar 193 bolted to the levers 177 as indicated at 194. This bar 193 is machined at the required pitch to provide a series of shallow vertical slots 195 extending along the whole of its length in each of which is accommodated a loose wall section 196 with adjacent wall sections 196 defining relatively deep slots 197, each for accommodating a looper blade 198.

These looper blades 198 are locked in the slots 197 by a full length loose clamping plate 199 tapped to carry screws 200 engageable with the looper bar 193, the clamping plate 199 thus being screwed to the front face of the looper bar 193. Grub screws 201 are screwed through the clamping plate 199 to engage angle faces 202 of the looper blades 198. Inadvertent upward movement of the looper blades 198 is prevented by the top of a full length looper carrier bar 203 which also forms a datum for the top of the looper blades 198.

The looper blades 198 can easily be removed and replaced by simply releasing a grub screw 201.

The looper bar 193 is formed of a series of end-to-end sections which are staggered at the joint lines, sections being easily removed if damaged and replaced.

It is to be noted that none of the shafts employed in this machine are keyed and that all "fast" connections are by means of shrink couplings giving infinitely variable axially and radial coupling (not tied to accuracy of machining). This gives substantial improvement in shaft stiffness and torsional resistance.

The yarn feed of the machine of the present invention is by means of three rollers 204 (FIGS. 1 and 2) all geared together with a relative percentage shift of input and output speeds of just under 1% to ensure non-stretching of the yarn.

Finally, the cloth feed rollers 205 (FIGS. 1 and 2) (front and rear) are each driven by a mechanical variator from the machine layshaft driven by the needle mechanism drive. The two variators are coupled together to permit relative speed and cloth tension adjustment while the machine is operational.

We claim:

1. A tufting machine comprising:

(A) a needle bar adapted for reciprocation;

(B) eccentric drive means adapted to impart reciprocating movement to the needle bar;

(C) a pivotal linkage system operatively connecting the eccentric drive means to the needle bar;

(D) the pivotal linkage system including (i) push link means pivotally connected to the needle bar, and (ii) stroke-adjusting link means pivotally connected to the push link means; and (E) an adjusting mechanism connected to the pivotal linkage system for determining the length of stroke of reciprocation of the needle bar;

(F) the adjusting mechanism including (i) gear means operable from an end of the tufting machine and including gear quadrant means and being adapted for movement along an arcuate path bodily to move the push link means and consequently to effect the needle bar stroke adjustment.

2. A tufting machine as claimed in claim 1, in which the pivotal linkage system comprises a push link pivotally connected to a push rod of the needle bar and connected to a cross shaft driven by the eccentric drive means, and a stroke-adjusting link pivotally connected to the push link via a pair of connecting links, the stroke-adjusting link being connected to the gear quadrant adjustable along an arcuate path by a gearwheel.

3. A tufting machine as claimed in claim 2, comprising a clamping arrangement adapted to lock the gear quadrant in adjusted position.

4. A tufting machine as claimed in claim 3, in which the clamping arrangement comprises a releasable mechanical locking means arranged between a fixed machine location and the gear quadrant and being adapted to resist arcuate movement.

5. A tufting machine as claimed in claim 4, in which the mechanical locking means comprises a pair of pivoted arms adapted to be urged into locking contact with the walls of a channel associated with the gear quadrant by spring means thereby to resist arcuate movement of the gear quadrant.

6. A tufting machine as claimed in claim 5, comprising a wedge adapted for engagement with the pivoted arms to force them into said locking contact with the channel walls.

7. A tufting machine as claimed in claim 6 comprising a piston-and-cylinder device connected to the wedge and adapted to remove it from between the pivoted arms against the action of the spring means to release the locking contact and thereby permit arcuate movement of the gear quadrant under the action of the quadrant-controlling gearwheel.

8. A tufting machine as claimed in claim 2, in which the quadrant-controlling gearwheel is fast on a shaft manually rotatable from one end of the tufting machine to effect needle bar stroke length adjustment.

9. A tufting machine as claimed in claim 8, comprising a rotatable handwheel connectible to an adjustment shaft adapted to rotate the quadrant-controlling gearwheel shaft via a reduction gear box.

10. A tufting machine as claimed in claim 9, in which the handwheel is adapted to be axially engaged with the adjustment shaft before rotation of the latter by the handwheel can be effected.

11. A tufting machine as claimed in claim 10, in which the axial engagement of the handwheel with the adjustment shaft simultaneously operates the piston-and-cylinder device to release the wedge of the needle bar stroke adjusting mechanism.

12. A tufting machine as claimed in claim 8, comprising complementary stop means provided on a rotating component of the quadrant-controlling gearwheel shaft and a fixed location of the machine to limit the arcuate travel of the gear quadrant.

13. A tufting machine as claimed in claim 8, comprising indicating means driven from the quadrant controlling gearwheel to show the amount of needle bar stroke adjustment being effected.

14. A tufting machine as claimed in claim 2, in which the needle bar is formed with an integral threader plate and is of extruded construction.

15. A tufting machine as claimed in claim 14, in which the extruded needle/threader bar is slidably accommodated in a recess in a bracket wherein it is secured by overlying locking strips, the bracket recess being of dovetail cross-section and the needle/threader bar being complementarily-shaped to be accommodated in the bracket recess, the bracket being part of the foot assembly of the machine.

16. A tufting machine comprising a needle bar assembly adapted for vertical reciprocatory movement by push rod means, the needle bar assembly comprising (A) a foot assembly comprising
  (i) a mounting bracket defining a recess, and
  (ii) yarn guide means;
(B) a needle bar adapted removably to mount needles;
(C) a threader bar integral with the needle bar and adapted to be received in the bracket recess;
(D) the integral needle/threader bar being of extruded construction; and
(E) securing means releasably mounted on the bracket and adapted to lock the integral needle/threader bar in the bracket recess.

17. A tufting machine as claimed in claim 16, in which the bracket recess is of dovetail cross-section, and the integral needle/threader bar has a dovetail formation for sliding engagement in the bracket recess.

18. A tufting machine as claimed in claim 16 in which the securing means comprises a pair of locking strips, each releasably secured to a side of the bracket and adapted to extend across the recess to engage an adjacent portion of the integral needle/threader bar.

19. A tufting machine as claimed in claim 18, in which the locking strips are bolted to the bracket.

20. A tufting machine as claimed in claim 16, in which the integral needle/threader bar releasably supports a row of spaced needles and defines yarn guides, one for each needle.

21. A tufting machine as claimed in claim 17 in which each needle is received in a bore defined by the integral needle/threader bar, a grub screw engaging the latter at each needle location to secure the needle releasably in position.

22. A tufting machine as claimed in claim 21 comprising extension pieces of different lengths adapted to mount the brackets to the foot assemblies to compensate the needles of different lengths and so ensure that all the needles are aligned with a predetermined datum line.

23. A tufting machine comprising a knife mechanism comprising (A) a reciprocable knife bar;
(B) a plurality of blade carrier modules;
(C) a plurality of blades removably secured in each carrier module;
(D) means releasably securing each carrier module to the knife bar, the securing means comprising
  (i) a bottom flange on each carrier module adapted to be releasably secured to the underside of the knife bar,
  (ii) an upturned hook formation on each carrier module adapted to abut the knife bar, and
  (iii) clamping lug means adapted to be releasably secured to the topside of the knife bar and to be engaged in the upturned hook formations of the carrier modules.

24. A tufting machine as claimed in claim 23 in which the clamping lug means comprises a clamping lug for each carrier module, each clamping lug being of inverted L-section with one limb being bolted to the topside of the knife bar and the other limb engaging in its respective upturned hood formation.

25. A tufting machine as claimed in claim 23, in which the bottom flange of each carrier module is bolted to the underside of the knife bar.

26. A tufting machine as claimed in claim 23, in which each carrier module defines a plurality of side-by-side blade mounting slots in each of which a blade is mounted, screw means cooperating with the carrier module to retain the blades releasably in position in the slots.

27. A tufting machine comprising a looper mechanism comprising (A) a plurality of end-to-end detachably connected bars, each defining along its length a multiplicity of parallel, relatively shallow, vertical slots;

(B) a wall section engagable in each vertical slots, and each pair of adjacent wall sections defining a relatively deep slot;

(C) a looper blade mounted between each pair of adjacent wall sections;

(D) a clamping plate secured to the interconnected bars and extending upwardly relative to the bars to prevent separation of the interconnected bars, wall sections and looper blades; and (E) screw means in the clamping plate for engaging each looper blade.

28. A tufting machine as claimed in claim 27, comprising a carrier bar to which the interconnected looper blade bars are connected, the carrier bar overlying the looper blade bars, wall sections and looper blades to resist upward movement of the latter and to define a datum for the top of the looper blades.

29. A tufting machine comprising (A) a looper mechanism;

(B) a knife mechanism parallel with the looper mechanism and adjacent thereto for cooperation therewith in tuft formation;

(C) independent driving means for the looper mechanism and the knife mechanism disposed at an end of the tufting machine and comprising and variable-stroke eccentric mechanism and timing belt transmission;

(D) a vertically-adjustable bedplate for supporting jute or cloth and arranged parallel with the adjacent looper and knife mechanisms and spaced longitudinally from the adjacent knife and looper mechanisms; and (E) the knife mechanism comprising (i) a reciprocable knife bar;

(ii) a plurality of blade carrier modules;

(iii) a plurality of blades removably secured in each carrier module; and (iv) means releasably securing each carrier module to the knife bar, the securing means comprising a bottom flange on each carrier module adapted to be releasably secured to the underside of the knife bar; an upturned hook formation on each carrier module adapted to abut the knife bar; and clamping lug means adapted to be releasably secured to the topside of the knife bar and to be engaged in the upturned hook formations of the carrier modules.

30. A tufting machine as claimed in claim 29, in which the looper mechanism comprises (A) a plurality of end-to-end detachably connected bars, each defining along its length a multiplicity of parallel, relatively shallow, vertical slots;

(B) a wall section engagable in each vertical slot, and each pair of adjacent wall sections defining a relatively deep slot;

(C) a looper blade mounted between each pair of adjacent wall sections;

(D) a clamping plate secured to the interconnected bars and extending upwardly relative to the bars to prevent separation of the interconnected bars, wall sections and looper blades; and (E) screw means in the clamping plate for engaging each looper blade.

31. A tufting machine comprising:

parallel looper and knife mechanisms independently driven via variable-stroke eccentric mechanisms and timing belt transmission arranged at least at one end of the machine, the looper and knife mechanisms being parallel with a vertically-adjustable, longitudinally-extending jute or cloth bedplate, and the driven parts of said looper and knife mechanisms being longitudinally spaced from an end of the bedplate whereby the central area of the machine between said driven parts of the mechanisms and the bedplate is free from driving shafts and ancillary driving components to provide substantial accessibility, a needle bar adapted for reciprocation;

eccentric drive means adapted to impart reciprocating movement to the needle bar;

a pivotal linkage system operatively connecting the eccentric drive means to the needle bar; the pivotal linkage system including a push link means pivotally connected to the needle bar, and a stroke-adjusting link means pivotally connected to the push link means;

an adjusting mechanism connected to the pivotal linkage system for determining the length of stroke of reciprocation of the needle bar; the adjusting mechanism including gear means operable from an end of the tufting machine and including gear quadrant means and being adapted for movement along an arcuate path bodily to move the push link means and consequently to effect the needle bar stroke adjustment.

* * * * *